US011287768B2

(12) United States Patent
Izawa

(10) Patent No.: US 11,287,768 B2
(45) Date of Patent: Mar. 29, 2022

(54) FIXING DEVICE INCLUDING ENDLESS BELT WITH A CUTOUT

(71) Applicant: HEWLETT-PACKARD DEVELOPMENT COMPANY, L.P., Spring, TX (US)

(72) Inventor: Tatsunori Izawa, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/279,245

(22) PCT Filed: Sep. 24, 2019

(86) PCT No.: PCT/US2019/052664
§ 371 (c)(1),
(2) Date: Mar. 24, 2021

(87) PCT Pub. No.: WO2020/076500
PCT Pub. Date: Apr. 16, 2020

(65) Prior Publication Data

US 2022/0004132 A1 Jan. 6, 2022

(30) Foreign Application Priority Data

Oct. 12, 2018 (JP) ..... JP2018-193360

(51) Int. Cl.
*G03G 15/20* (2006.01)
*G03G 21/20* (2006.01)

(52) U.S. Cl.
CPC ..... *G03G 15/2064* (2013.01); *G03G 15/2053* (2013.01); *G03G 21/206* (2013.01); *G03G 15/2057* (2013.01); *G03G 2215/2032* (2013.01)

(58) Field of Classification Search
CPC ..... G03G 15/2053; G03G 2215/2032; G03G 21/206
See application file for complete search history.

(56) References Cited

U.S. PATENT DOCUMENTS

| | | | | |
|---|---|---|---|---|
| 5,890,032 | A * | 3/1999 | Aslam | G03G 15/2039 399/69 |
| 6,618,573 | B2 | 9/2003 | Ishikawa et al. | |
| 2007/0166071 | A1 | 7/2007 | Shima | |
| 2012/0051812 | A1* | 3/2012 | Yamano | G03G 15/2053 399/341 |

FOREIGN PATENT DOCUMENTS

| | | |
|---|---|---|
| EP | 2538280 | 12/2012 |
| JP | 5-165350 | 7/1993 |
| JP | 2001-215845 | 8/2001 |
| JP | 2009-244743 | 10/2009 |
| JP | 2010-122568 | 6/2010 |
| JP | 2000-330402 | 11/2010 |
| JP | 2018-97318 | 6/2018 |

* cited by examiner

*Primary Examiner* — Arlene Heredia
(74) *Attorney, Agent, or Firm* — Staas & Halsey LLP

(57) ABSTRACT

A fixing device includes an endless belt to rotate about rollers, including a heat roller. A pressure roller presses the endless belt against the heat roller. A cooling device is located adjacent a portion of the endless belt, that moves from the heat roller to the tension roller. The endless belt has a cutout, and the heat roller directly contacts the pressure roller through the cutout, when the cutout of the endless belt is located between the pressure roller and the heat roller.

15 Claims, 9 Drawing Sheets

FIXING DEVICE INCLUDING ENDLESS BELT WITH A CUTOUT

BACKGROUND

Some imaging apparatuses employing an electrophotographic system, such as a copier, printer, facsimile or multifunctional machine, heat and pressurize a recording medium for fixing onto the recording medium a toner image carried by the recording medium, and output the recording medium with the formed toner image (i.e., print output). In recent years, with the popularization of digital cameras and the like, there has been an increasing demand for photographic or glossy print outputs. A cooling-and-releasing technique may produce such glossy print outputs. The cooling-and-releasing technique may heat and pressurize a recording medium formed with a toner image once more to melt the toner image anew, and may cool the recording medium while in a state of overlay (or abutment) with an endless belt before releasing the recording medium. As the recording medium is laid over (or kept in abutment with) the endless belt during its cooling, the re-melted (e.g. heat-fused) toner image reproduces the mirror-finished surface of the endless belt and solidifies to impart glossiness to the toner image.

DETAILED DESCRIPTION

Figure 1:
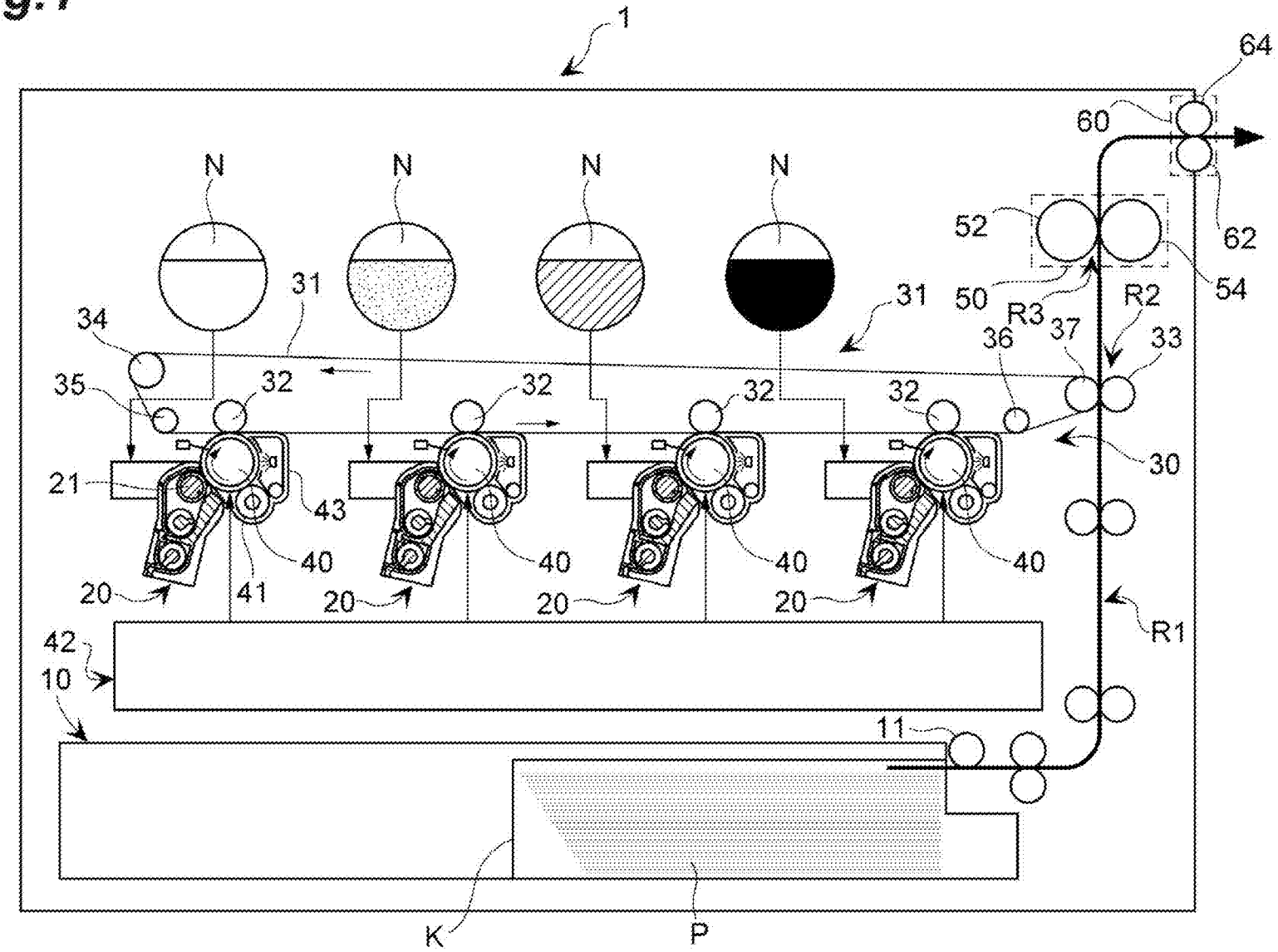
FIG. 1 is a schematic diagram of an example imaging apparatus.

An example fixing device includes a heat roller containing a heating device, a tension roller, an endless belt tensioned around the heat roller and the tension roller to move in a loop (or circularly), a pressure roller to make pressure contact with the heat roller via the endless belt to form a fixing nip part, and a cooling device disposed on an inner peripheral surface side of the endless belt to cool the endless belt moving from the heat roller to the tension roller, wherein the endless belt has a cutout and the heat roller can rotate in direct contact with the pressure roller through the cutout. In the example fixing device, the heat roller may rotate in direct contact with the pressure roller through the cutout during a warm-up (pre-heating) process before feeding paper, in order to shorten the time for increasing a surface temperature of the pressure roller to a predetermined temperature and to reduce power consumption. Accordingly, the time for increasing a surface temperature of the pressure roller to a predetermined temperature can be shortened and power consumption can be reduced thereby.

In some examples of the fixing device, the cutout of the endless belt may be cut to leave lateral edges on both sides of the endless belt, the heat roller may include bearings at both ends of the heat roller outside a portion of the heat roller that comes in contact with the pressure roller, and the bearings may be arranged to make contact with the lateral edges selectively or in some cases exclusively, of the endless belt. In such fixing device, the heat roller may rotate in contact with the pressure roller through the cutout during a warm-up (or pre-heating) process before feeding paper, in order to evenly heat the pressure roller. Accordingly, the pressure roller can be uniformly heated by the heat roller.

In some examples of the fixing device, in the direction of movement of the endless belt, the cutout of the endless belt may have a length that is longer than half of the total length of the outer circumference of the heat roller and shorter than the total length of the outer circumference of the heat roller, and may have a width larger than a width over which the heat roller and the pressure roller come in contact with each other. In such fixing devices, the heat roller may rotate in direct contact with the pressure roller when the cutout is located at a fixing nip part, in order to evenly heat the pressure roller. Accordingly, the pressure roller can be uniformly heated by the heat roller.

In some examples, the fixing device may include a first driving device for rotationally driving the heat roller and a second driving device for rotationally driving the tension roller. When the cutout of the endless belt is located at the fixing nip part, the heat roller may rotate in contact (or abutment) with the pressure roller, with the endless belt being in a stopped state, by driving the first driving device and keeping the second driving device in a state of non-operation. In such fixing devices, the rotational driving of the tension roller can be controlled separately from the rotational driving of the heat roller, and the heat roller may rotate in contact with the pressure roller through the cutout during a warm-up (or pre-heating) process before feeding paper, in order to evenly heat the pressure roller. Accordingly, the pressure roller can be uniformly heated by the heat roller.

In some examples, the fixing device includes a position sensor for detecting the position of the cutout of the endless belt. The fixing device may include a temperature sensor for detecting a surface temperature of the pressure roller. In such fixing devices, the operation of the fixing device may be controlled based on detection signals from the position sensor and the temperature sensor.

In some examples of the fixing device, the heating device may include a first heating device and the pressure roller may contain a second heating device. In such fixing devices, the time for increasing the surface temperature of the pressure roller to the predetermined temperature can be shortened during a warm-up (or pre-heating) process before feeding paper.

In examples of the fixing device, the cooling device may include a blower device or a heat sink. In such fixing devices, a re-melted toner image (e.g. a toner image having been heat-fused a second time after a first heat-fusing and cooling) can be cooled while being in a state of overlay (or abutment) with a portion of the endless belt devoid of the cutout.

In some example fixing devices, the cooling device may include a blower device to discharge air from a space surrounded by the endless belt, to the outside through the cutout of the endless belt, in order to inhibit a temperature increase in the space surrounded by the endless belt. Accordingly, in such fixing devices, increase in the temperature can be suppressed in the space surrounded by the endless belt.

In some examples, an imaging apparatus may have a fixing device according to the aforementioned examples, in order to provide photographic or glossy (e.g. glossiness-imparted) print outputs.

An example method for manufacturing a fixing apparatus may include tensioning an endless belt around a heat roller containing a heating device and a tension roller to enable movement in a loop (or circularly), pressure-contacting a pressure roller to the heat roller (e.g. the pressure roller may be pressed against and in to contact with the heat roller) via the endless belt to form a fixing nip part, disposing a cooling device on an inner peripheral surface side of the endless belt to cool the endless belt moving from the heat roller to the tension roller, and forming a cutout in the endless belt so that the heat roller can rotate in direct contact with the pressure roller. With such method, a fixing apparatus can be provided, which is adapted to shorten the time for increasing a surface temperature of the pressure roller to a predetermined temperature during a warm-up (or pre-heating) process before feeding paper.

In some examples of the method, forming the cutout in the endless belt includes forming the cutout to leave lateral edges on both sides (e.g. along the two side edges) of the endless belt. Some example methods include disposing bearings at both ends of the heat roller outside a contact portion where the heat roller comes in contact with the pressure roller, wherein the bearings are arranged to make contact selectively or in some cases exclusively with the lateral edges of the endless belt. Accordingly, the heat roller may rotate in contact with the pressure roller through the cutout during a warm-up (or pre-heating) process before feeding paper, and a fixing device can be provided, which may be adapted to uniformly or evenly heat the pressure roller by way of the heat roller.

In some examples of the method, in the direction of movement of the endless belt, the cutout has a length that is longer than half of the total length of the outer circumference of the heat roller and shorter than the total length of the outer circumference of the heat roller, and a width larger than a width over which the heat roller and the pressure roller come in contact with each other. Accordingly, a fixing apparatus can be provided, which is adapted so that the heat roller may rotate in direct contact with the pressure roller when the cutout is located at a fixing nip part and the pressure roller can be uniformly or evenly heated by the heat roller.

Some example methods may include disposing a first driving device for rotationally driving the heat roller and a second driving device for rotationally driving the tension roller. With such method, a fixing device can be provided, which is adapted so that the rotational driving of the tension roller can be controlled separately from the rotational driving of the heat roller, the heat roller may rotate in contact with the pressure roller through the cutout during a warm-up (or pre-heating) process before feeding paper, and the pressure roller can be uniformly or evenly heated by the heat roller.

In the following description, with reference to the drawings, the same reference numbers are assigned to the same components or to similar components having the same function, and overlapping description is omitted.

FIG. 1 is a schematic drawing of an example imaging apparatus 1. The imaging apparatus 1 may be an apparatus to form color images using magenta, yellow, cyan and black colors. The imaging apparatus 1 may be provided with a transport unit 10 for transporting a recording medium such as a paper sheet P, developing devices 20 for developing electrostatic latent images, a transfer unit 30 for secondarily transferring a toner image to the paper sheet P, photosensitive drums 40 that are electrostatic latent image carriers (image carriers) having circumferential surfaces on which images may be formed, a fixing unit 50 for fixing the toner image onto the paper sheet P, and a discharge unit 60 for discharging the paper sheet P.

The transport unit 10 may transport the paper sheet P (e.g. a recording medium on which image is to be formed) along a transport path R1. The paper sheets P may be stacked and contained in a cassette K, picked up by a feed roller and transported. The transport unit 10 transports the paper sheet P to reach a transfer nip part R2 through the transport path R1 in such a timing that the toner image to be transferred to the paper sheet P arrives at the transfer nip part R2.

Four developing devices 20 may be provided, one for each of the respective colors. Each of the developing devices 20 may include a developer roller 21 for carrying toner to the photosensitive drum 40. In the developing device 20, toner and carrier may be adjusted at a suitable and/or target mixing ratio, and mixed and stirred to disperse the toner uniformly so as to prepare a developer imparted with an optimal or suitable amount of charge. The developer is then carried by the developer roller 21. As the developer roller 21 rotates to carry the developer to a region aligned with or facing the photosensitive drum 40, toner is transferred from the developer carried on the developer roller 21 onto an electrostatic latent image formed on a circumferential surface of the photosensitive drum 40, to develop the electrostatic latent image.

The transfer unit 30 may carry the toner image formed with the developing devices 20 to the transfer nip part R2 for secondary transfer to the paper sheet P. The transfer unit 30 may include a transfer belt 31 onto which the toner image is primarily transferred from the photosensitive drums 40, support rollers 34, 35, 36 and 37 for supporting the transfer belt 31, primary transfer rollers 32 for holding the transfer belt 31 with the photosensitive drums 40, and a secondary transfer roller 33 for holding the transfer belt with the support roller 37.

The transfer belt 31 may be an endless belt circularly moved (e.g. driven in a loop) by the support rollers 34, 35, 36 and 37. The support rollers 34, 35, 36 and 37 are rollers rotatable about respective center axes (or rotational axes). The support roller 37 may be a driving roller that is powered to rotate about its rotational axis, for rotationally driving about its rotational axis. The support rollers 34, 35 and 36 may be driven rollers rotatable to follow the rotation of the rotational driving of the support roller 37. The primary transfer rollers 32 may be disposed to press against the photosensitive drums 40 from the inner peripheral side of the transfer belt 31. The secondary transfer roller 33 may be disposed in parallel with the support roller 37, wherein the endless belt 31 is captured or pinched between the secondary transfer roller 33 and the support roller 37, to press against the support roller 37 from the outer peripheral side of the transfer belt 31. Thereby, the secondary transfer roller 33 may form the transfer nip part R2 with the transfer belt 31.

Four photosensitive drums 40 are provided, one for each of the respective colors. Each of the photosensitive drums 40 may be provided along the direction of movement of the transfer belt 31. Around the circumference of the photosensitive drum 40, the developing device 20, a charge roller 41, an exposure unit 42 and a cleaning unit 43 are arranged.

The charge roller 41 may uniformly or evenly charge the surface of the photosensitive drum 40 to a predetermined potential. The charge roller 41 may move to follow the rotation of the photosensitive drum 40. The exposure unit 42 may expose the surface of the photosensitive drum 40 charged by the charge roller 41 in accordance with an image to be formed on the paper sheet P. The potential of portions on the surface of the photosensitive drum 40 exposed by the exposure unit 42 is thereby changed to form an electrostatic latent image. Toner tanks N are mounted opposite the respective developing devices 20 to supply the toner to the respective developing devices 20. With the toner supplied from the toner tanks N, the four developing devices 20 may develop the electrostatic latent images formed on the photosensitive drums 40 to form a toner image. The toner tanks N are filled with magenta, yellow, cyan and black toners, respectively. The cleaning unit 43 may collect the toner remaining on the photosensitive drum 40 after the toner image formed on the photosensitive drum 40 has been primarily transferred onto the transfer belt 31.

The fixing unit 50 may convey the paper sheet P to pass through a fixing nip part R3 that heats and pressurizes the paper sheet P to perform fixing by adhering the toner image that has been secondarily transferred from the transfer belt 31 to the paper sheet P. The fixing unit 50 is provided with a heat roller 52 for heating the paper sheet P and a pressure roller 54 for pressing against and rotationally driving the heat roller 52, in order to heat-fuse the toner image a first time. The heat roller 52 and the pressure roller 54 have cylindrical shapes, and the heat roller 52 is provided therein with a heat source such as a halogen lamp. A contact area (e.g. the fixing nip part R3) may be formed between the heat roller 52 and the pressure roller 54, and the toner image may be fused and fixed onto the paper sheet P by passing the paper sheet P through the fixing nip part R3.

The discharge unit 60 may be provided with discharge rollers 62 and 64 for discharging the paper sheet P, onto which the toner image has been fixed by the fixing unit 50, to the outside of the apparatus.

Figure 2:
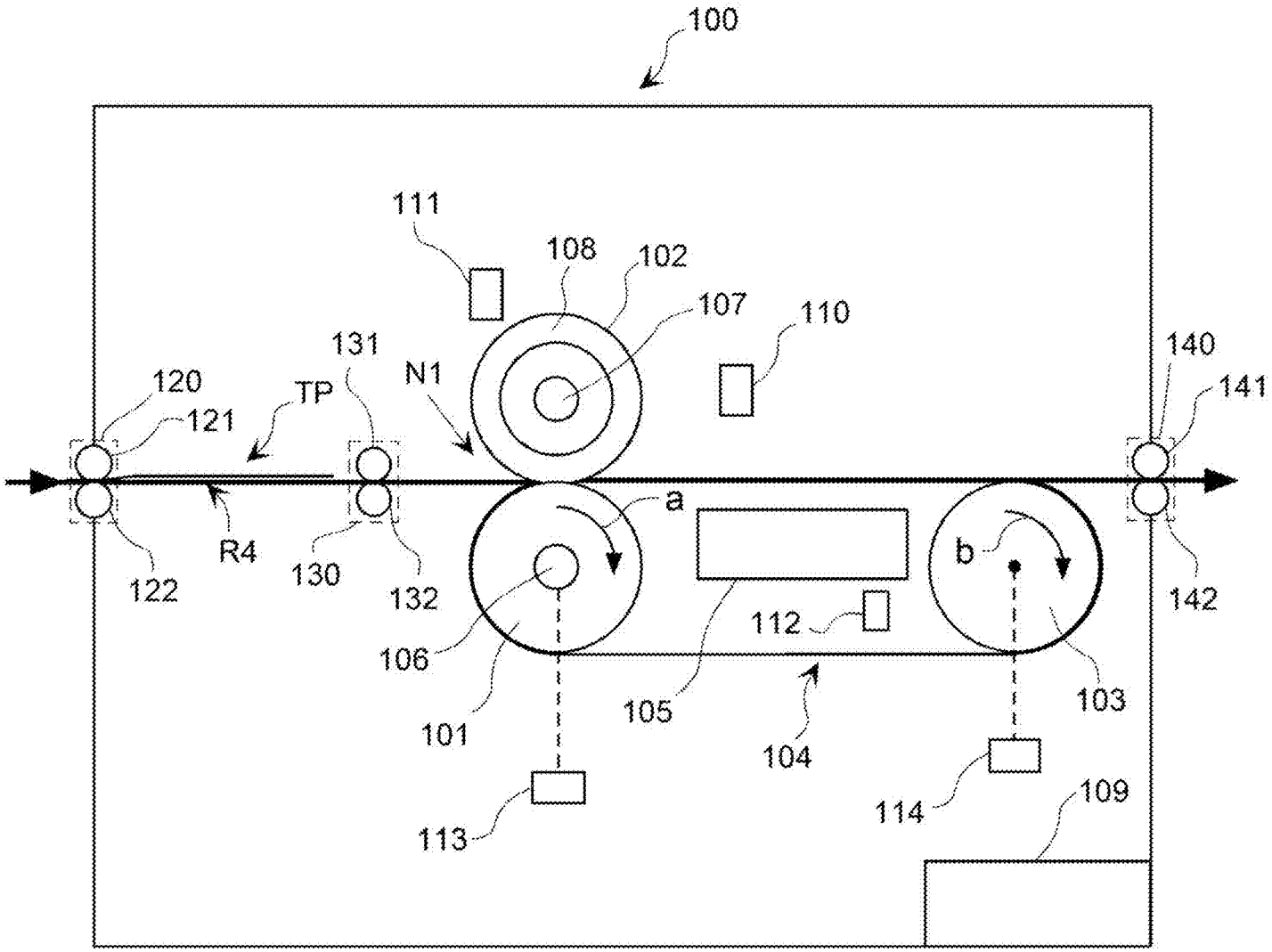
FIG. 2 is a schematic diagram showing an example fixing apparatus.

FIG. 2 schematically illustrates an example fixing device 100 which may be removably attached to the example imaging apparatus 1 of FIG. 1. Although the example fixing device 100 is shown as separate from the imaging apparatus 1, in some examples, the fixing apparatus 100 may be contained within the imaging apparatus 1. In such a case, the fixing unit 50 of the imaging apparatus 1 may be a fixing unit having a cooling function. The fixing apparatus 100 may use the aforementioned cooling-and-releasing technique to impart glossiness to a paper sheet formed with a toner image (hereinafter, referred to as a paper sheet TP formed with a toner image or a paper sheet TP) from the imaging apparatus 1.

The example fixing apparatus 100 may include a heat roller 101 containing a heating device 106, a tension roller 103, an endless belt 104 tensioned around the heat roller 101 and the tension roller 103 to be driven in a loop (or circularly), a pressure roller 102 to make pressure contact with the heat roller 101 via the endless belt 104 to form a fixing nip part N1, and a cooling device 105 disposed on an inner peripheral surface side of the endless belt 104 to cool a portion of the endless belt 104 moving from the heat roller 101 to the tension roller 103.

The example fixing apparatus 100 may receive a paper sheet TP formed with a toner image from the imaging apparatus 1 through an input device 120. In this case, the paper sheet TP may be received by the fixing apparatus 100 such that a surface of the paper sheet TP formed with the toner image comes in contact with the endless belt 104 (e.g. in a state in which the surface of the paper sheet TP formed with the toner image is an underside surface of the paper sheet TP in the example of FIG. 2). With reference to FIG. 2, the paper sheet TP may be transported along a transport path R4. The input device 120 may be provided with input rollers 121, 122. The paper sheet TP may be conveyed by a transport device 130 to the fixing nip part N1. The transport device 130 may include transport rollers 131, 132. The paper sheet TP may be heated and pressurized once more at the fixing nip part N1 and the toner image is thereby re-melted (e.g. the paper sheet TP is heat-fused a subsequent time). The heat-fused (re-melted) toner image is then transported in a state of overlay or (abutment) with the endless belt 104, and cooled by the cooling device 105. The cooling device 105 may be a blower device or a heat sink. As the endless belt 104 diverges from the transport path R4 (e.g. where the endless belt 104 changes the transport direction) at the tension roller 103, the paper sheet TP is released from the endless belt 104 and discharged by a discharge device 140. The discharge device 140 may include discharge rollers 141, 142.

Figure 3:
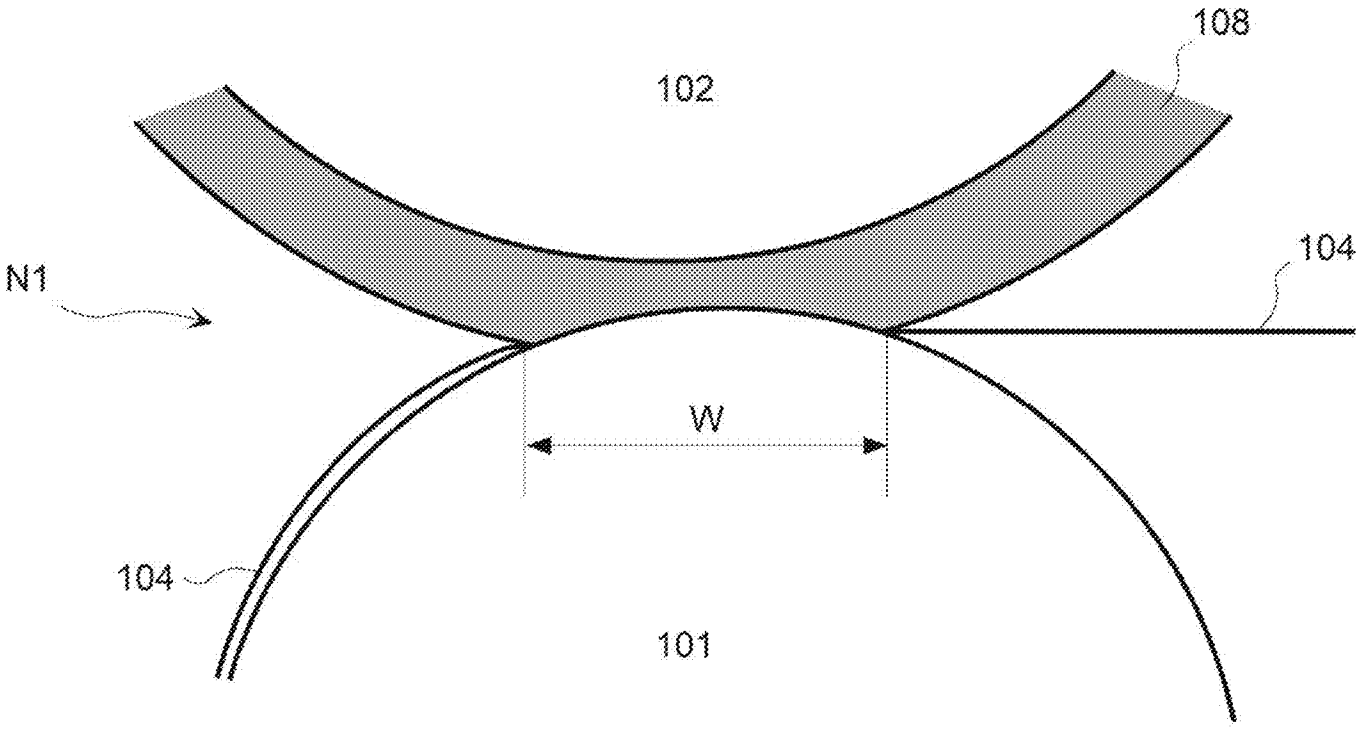
FIG. 3 is a schematic diagram of an example fixing nip part N1.
Figure 4:
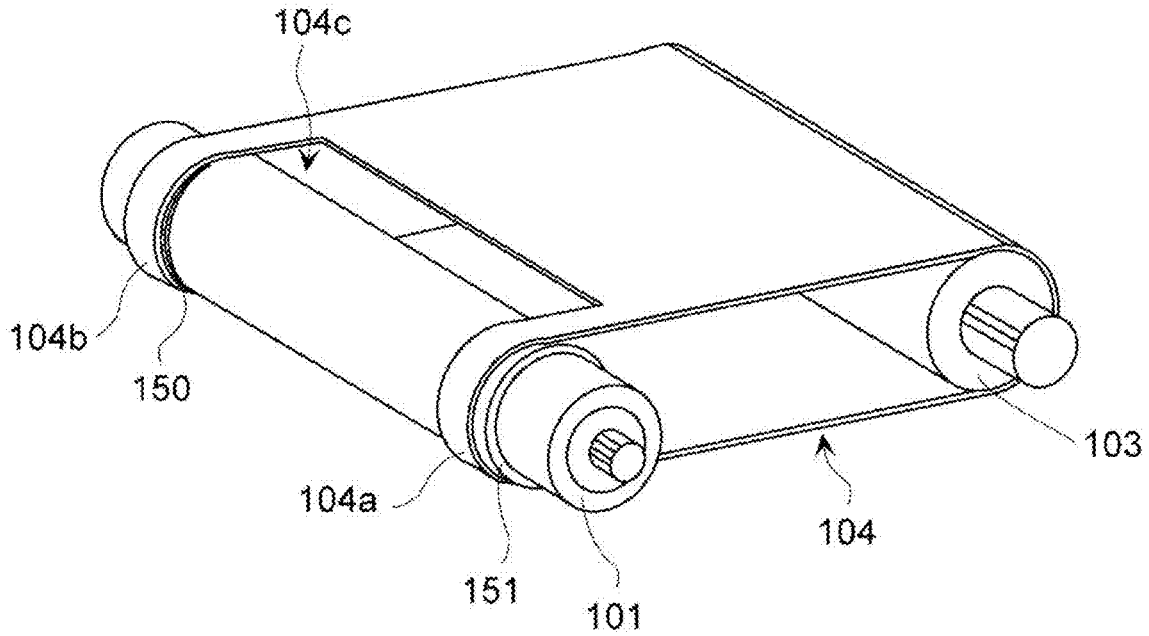
FIG. 4 is a schematic diagram of showing an example endless belt.

With reference to FIG. 4, the example endless belt 104 may have a cutout 104*c* where a portion of the endless belt is open (e.g. a portion of the endless belt has been cut and removed). The example endless belt 104 is described further below. In order to heat-fuse (re-melt) a toner image at the fixing nip part N1, it may be necessary for the fixing nip part N1 to have a predetermined temperature before feeding paper. The heat roller 101 includes the heating device 106, such as a halogen lamp, and may have a substantially hard surface (e.g. not provided with an elastic layer on the surface of the heat roller 101) for improving thermal conductivity. On the other hand, the pressure roller 102 may be provided with an elastic layer 108 (see FIG. 3) to increase a contact area or contact surface (fixing nip part N1) for conducting heat to the paper sheet TP. The pressure roller 102 may contain a heating device 107, such as a halogen lamp, for heating the fixing nip part N1 to have a predetermined temperature. However, as the pressure roller 102 is provided with the elastic layer 108 and the thermal conductivity is low, the temperature of the pressure roller may be relatively slow to increase. As such, a rotation operation may be performed during a warm-up (or pre-heating) process before feeding paper, so that heat from the heat roller 101 may be used to assist the temperature increase of the pressure roller 102. Then, if the endless belt 104 is not provided with the cutout 104*c*, heating of the pressure roller 102 by the heat roller 101 may become inefficient, as the endless belt 104 is interposed between the heat roller 101 and the pressure roller 102. Also, as there is no need to heat the endless belt 104, it may have to be cooled by the cooling device 105. The endless belt 104 is thus heated and cooled during the circular (or loop) movement, and this may further inhibit the efficiency of the warm-up (or pre-heating) process which may lead to waste and loss of energy and time.

With reference to FIG. 4, the endless belt 104 may be tensioned around the heat roller 101 and the tension roller 103. The pressure roller is not shown in FIG. 4 for ease of understanding. The endless belt 104 may be a continuous belt that undergoes circular movement. A portion of the endless belt 104 is cut and removed to leave lateral edges 104*a*, 104*b* on both sides of the endless belt, and the cutout 104*c* is thereby provided. The cutout may be formed, for example, by punching press working (e.g. punch-pressing) or by laminating sheet components provided with cutouts in advance (e.g. layering pre-cut sheet components), and may be formed by any other methods suitable for providing a cutout in the endless belt.

In the axial direction of the heat roller 101, the width of the cutout 104*c* may be slightly larger than a maximum width of the recording medium or a width over which the pressure roller makes contact with the heat roller, and the endless belt 104 may not be captured or seized between the pressure roller 102 and the heat roller 101 at the cutout 104*c*. Further, in the running direction of the endless belt, the length of the cutout 104*c* may be longer than half of the total length of the outer circumference of the heat roller and shorter than the total length of the outer circumference of the heat roller.

Figure 5:
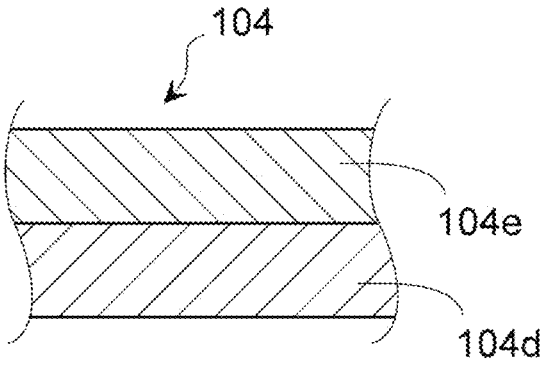
FIG. 5 is a schematic cross sectional view of an example endless belt.

With reference to FIG. 5, the endless belt 104 may have a layered structure having two or more layers and may include a base layer 104*d* and a surface layer 104*e*. The base layer 104*d* is an inner layer (e.g. a layer on the inner peripheral side) of the endless belt 104. The base layer 104*d* may impart rigidity to the endless belt 104. The base layer 104*d* may be made of a resin or metal. When the base layer is made of a resin, the resin material for the base layer 104*d* may include polyimide (PI), polyetheretherketone (PEEK), polyamide (PA) or a composition comprising at least one of the aforementioned polyimide (PI), polyetheretherketone (PEEK), and polyamide (PA), in view of their high temperature resistance.

The thickness of the base layer 104*d* made of a resin may be 150 μm or less in some examples, or 100 μm or less in other examples, in order to suppress the lowering of thermal conductivity and to suppress the lowering of conformability of the endless belt 104 to the shape of the nip. The thickness of the base layer 104*d* made of a resin may be 30 μm or more in some examples, or 50 μm or more in other examples, in order to increase life span (e.g. to suppress the shortening of life due to strength lowering). The thickness of the base layer 104*d* made of a resin may be 30 μm or more and 150 μm or less in some examples, or 50 μm or more and 100 μm or less in other examples.

The thermal conductivity of the base layer 104*d* made of a resin may be 2.0 W/mK or less in some examples, or 1.6 W/mK or less in other examples, in order to improve durability of the base layer 104*d* (e.g. to suppress the lowering of durability of the base layer 104*d*). The thermal conductivity of the base layer 104*d* made of a resin may be 0.1 W/mK or more in some examples, or 0.2 W/mK or more in other examples, for ease of manufacturing the base layer 104*d*. The thermal conductivity of the base layer 104*d* made of a resin may be 0.1 W/mK or more and 2.0 W/mK or less in some examples, or 0.2 W/mK or more and 1.6 W/mK or less in other examples.

When the base layer is made of metal, the metal material for the base layer 104*d* may include SUS, Cu, Ni or an alloy containing at least one of SUS, Cu, and Ni, in view of their high thermal conductivity. The thickness of the base layer 104*d* made of metal may be 70 μm or less in some examples, or 50 μm or less in other examples, to suppress the lowering of thermal conductivity and to suppress the lowering of conformability of the endless belt 104 to the shape of the nip. On the other hand, the thickness of the base layer 104*d* made of metal may be 5 μm or more in some examples, or 10 μm or more in other examples, in order to improve lifespan (e.g. to suppress the shortening of life due to strength lowering). As such, the thickness of the base layer 104*d* made of metal may be 5 μm or more and 70 μm or less in some examples, or 10 μm or more and 50 μm or less in other examples.

The thermal conductivity of the base layer 104*d* made of metal may be 600 W/mK or less in some examples, or 400 W/mK or less in other examples, for improved durability of the base layer 104*d* (e.g. to suppress the lowering of durability of the base layer 104*d*). The thermal conductivity of the base layer 104*d* made of metal may be 10 W/mK or more in some examples, or 15 W/mK or more in other examples, for improved fixing performance. The thermal conductivity of the base layer 104*d* made of metal may be 10 W/mK or more and 600 W/mK or less in some examples, or 15 W/mK or more and 400 W/mK or less in other examples.

The surface layer 104*e* may be an outer layer (e.g. a layer on the outer peripheral side) of the endless belt 104. The surface layer 104*e* may impart a mirror-finished surface, as well as releasability of the paper sheet P, to the endless belt 104. The surface layer 104*e* may be made of any suitable material that may be processed to have a mirror surface and provide suitable releasability. The surface layer 104*e* may be made of, for example, a fluoro resin, such as perfluoroalkoxyalkane (PFA). The thickness of the surface layer 104*e* may be 5 μm or more and 100 μm or less in some examples, or 10 μm or more and 50 μm or less, in other examples, in order to improve durability and fixing performance. The surface of the surface layer 104*e* may be formed as a mirror surface or smooth surface suitable for imparting glossiness, and the smooth surface may be formed, for example, with an arithmetic surface roughness Ra of 0.3 μm or less in some examples, or 0.1 μm or less in other examples.

Figure 6:
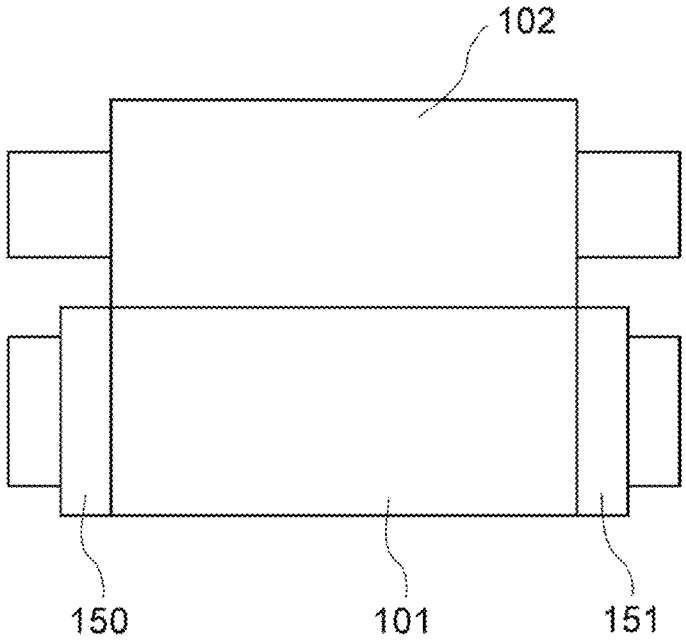
FIG. 6 is a schematic diagram of a front view of a heat roller and a pressure roller in a state where a cutout is located at the fixing nip part, in an example fixing device.

With reference to FIG. 2, the heat roller 101 may include a cylindrical member made of a metal material. For example, the heat roller 101 may include a hollow member formed of aluminum or the like, having an outer diameter (diameter) of 30 to 60 mm. The heating device 106, such as a halogen lamp, may be contained within the hollow portion of the heat roller 101, and the heat roller 101 may be heated by the heating device 106. With reference to FIG. 6, the heat roller 101 may have bearings 150, 151 at both ends of the heat roller 101 outside a portion that comes in contact with the pressure roller 102 (the fixing nip part N1). FIG. 6 does not show the endless belt 104, for ease of understanding. The outer circumferential surfaces of the bearings 150, 151 may be adapted to be aligned (flush) with the outer circumferential surface of the heat roller 101. The bearings may include ball bearings or roller bearings made of metal or ceramic. Insulating materials may be provided between the heat roller 101 and the bearings 150, 151, so that heat of the heat roller 101 will not dissipate through the bearings 150, 151.

With reference to FIG. 4, the endless belt 104 may be adapted such that the lateral edges 104*a*, 104*b*, exclusively, of the endless belt make contact with the bearings 150, 151 when the cutout 104*c* is located at the heat roller 101. In this case, the pressure roller 102 may abut with the heat roller 101 by way of the cutout 104*c* of the endless belt 104 (e.g. not via the endless belt).

Referring back to FIG. 2, the pressure roller 102 may be a cylindrical hollow member made of a metal material. In some examples, the pressure roller 102 may be formed of aluminum or the like material, and a 100 μm to 10 mm thick silicone rubber layer may be formed on the outer circumference of the cylindrical metal member, over an outer surface of which a 1 μm to 100 μm thick fluoro resin layer may further be formed. The silicone rubber layer and the fluoro resin layer may be collectively referred to as the elastic layer 108. The heating device 107 such as a halogen lamp may be contained in the hollow portion of the pressure roller 102. When the pressure roller 102 is heated by the heating device 107, the temperature of the surface of the pressure roller 102 may increase more slowly than the heat roller 101 due to the presence of the elastic layer 108. In a warm-up (or pre-heating) process before feeding paper, the pressure roller may be heated by the heat roller to assist the temperature increase of the pressure roller. The pressure roller 102 may make pressure contact with the heat roller 101 via a portion of the endless belt 104 devoid of the cutout 104*c* to form the fixing nip part N1. The fixing nip part N1 may be set to have a width (FIG. 3) of about 3 to 15 mm.

The heat roller 101 may be driven by a driving device 113 to rotate in the direction indicated by an arrow a. The tension roller 103 may be driven by a driving device 114 to rotate in the direction indicated by an arrow b. For example, the heat roller 101 and the tension roller 103 may drive the endless belt to transport the paper sheet TP from the fixing nip part N1 to the tension roller 103. The speed of movement of the endless belt in this case may be 5 to 200 mm/sec. The driving devices 113, 114 may be controlled by a controller 109. The pressure roller 102 may follow the movement by coming into contact (or abutment) with the heat roller 101 or the endless belt 104.

With reference to FIG. 2, a position sensor 110 may detect the position of the cutout 104*c* of the endless belt 104. The position sensor 110 may be an optical or other non-contact sensor. A temperature sensor 111 may detect a surface temperature of the pressure roller, and a temperature sensor 112 may measure the temperature in a space surrounded by the endless belt 104. The temperature sensors 111, 112 may be non-contact sensors such as thermistors or thermopiles. Detection signals from the position sensor 110 and the temperature sensors 111, 112 are delivered to the controller 109.

The controller 109 may control the operation of the fixing device 100 based on control signals from a user input device (not shown) mounted to the fixing device 100 or from the outside, as well as output signals from the position sensor 110 and the temperature sensors 111, 112. When the cooling device 105 is a blower device, the controller 109 may also control the operation of the blower device. The controller 109 may be provided with a processor such as a CPU, and storage devices for storing executable codes executable by the processor.

Figure 7A:
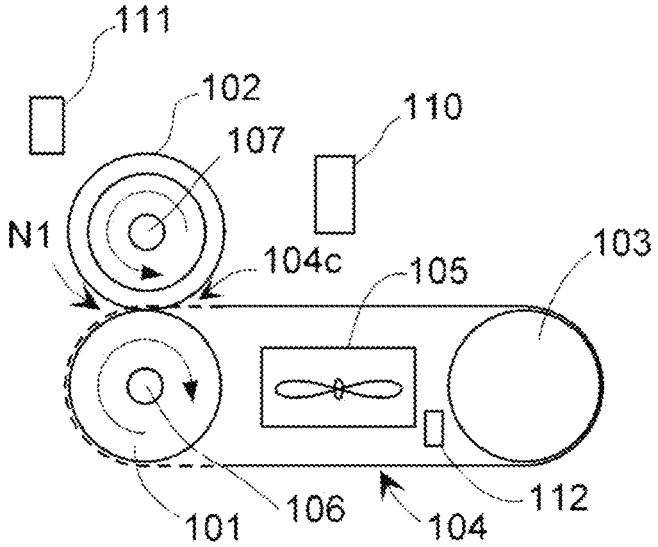
FIG. 7*a* is a schematic side plan view of an example fixing device in a warm-up state.
Figure 7B:
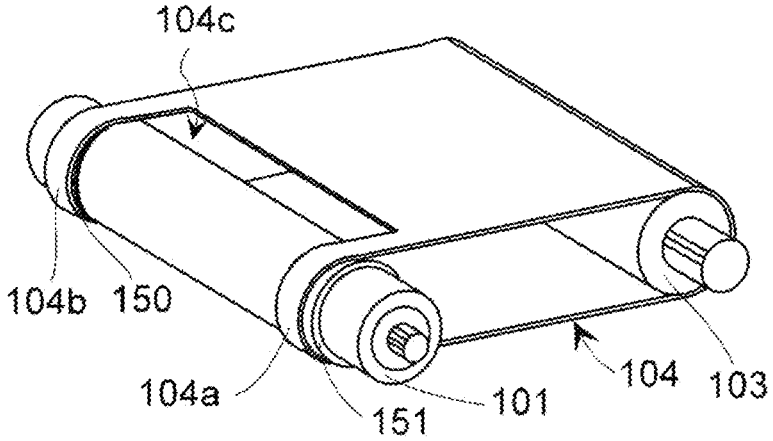
FIG. 7*b* is a schematic perspective view of the example fixing device shown in FIG. 7*a*.

An example operation of the fixing device 100 will be described with reference to FIG. 7*a* to FIG. 7*f*. FIG. 7*a* to FIG. 7*f* schematically show the fixing device 100 in a state of warm-up (or pre-heating) before feeding paper (FIG. 7*a*, 7*b*), a state of cooling the toner image (FIG. 7*c*, 7*d*), and a state of cooling the space surrounded by the endless belt (FIG. 7*e*, 7*g*). In particular, the pressure roller 102, the paper sheet TP and others are removed from the lower figures in FIG. 7*a* to FIG. 7*f* to clearly show the states of the endless belt 104. Further, FIG. 7*a* to FIG. 7*f* also show a case where the cooling device 105 is a blower device. FIGS. 7*a* and 7*b* illustrate a warm-up (or pre-heating) process before feeding paper. In this case, the paper sheet TP formed with a toner image may be stopped at the transport device 130, in a standby state. Further, the blower device, e.g., the cooling device 105, is stopped from operating. As mentioned above, the temperature of the surface of the pressure roller 102 may be slower to increase than the heat roller 101, for example, due to the presence of the elastic layer 108. Accordingly, the heat roller 101 is used for heating the pressure roller 102 to assist the temperature increase of the pressure roller 102. The controller 109 (FIG. 2) controls the driving devices 113, 114 (FIG. 2) based on a detection signal from the position sensor 110 (FIG. 2) to locate the cutout 104*c* at the fixing nip part N1.

When the cutout 104*c* is located at the fixing nip part N1, the controller 109 may control the driving device 114 to stop the operation of the tension roller 103. On the other hand, the controller 109 controls the driving device 113 so that the heat roller 102 continues the rotational operation. In this case, the endless belt 104 makes contact with the bearings 150, 151 of the heat roller 101 at the lateral edges 104*a*, 104*b*, selectively or in some cases exclusively, of the endless belt 104. The rotational operation of the heat roller may not be transmitted to the endless belt 104 because of the bearings 150, 151. For example, in the warm-up (or pre-heating) state of FIGS. 7*a* and 7*b*, while the heat roller 101 and the pressure roller 102 are rotationally operated, the endless belt 104 is stopped. As the heat roller 101 rotates in contact (or abutment) with the pressure roller 102 in this manner, the pressure roller 102 may be uniformly (or evenly) heated until the surface temperature reaches a predetermined temperature, namely a melting temperature or more of the toner used for the paper sheet TP (e.g. until the surface temperature reaches or exceeds a temperature at which the toner fuses), for example 100° C. to 180° C., such that the time for the pressure roller to reach the predetermined temperature can be shortened. In this case, the endless belt 104 is not heated by the heat roller 101. Therefore, as the endless belt 104 to be cooled by the cooling device 105 is not heated by the heat roller 101, the power consumption of the apparatus can also be reduced. Further, the rotation speed of the heat roller 101 may be higher than the rotation speed used for transporting, so as to further shorten the time for the heat roller 102 to reach the predetermined temperature. For example, the rotation speed of the heat roller 101 may be increased to 1.5 to 10 times the rotation speed used for transporting.

Upon detecting, based on the detection signal of the temperature sensor 111, that the surface temperature of the pressure roller 102 has reached the predetermined temperature, the controller 109 may control the driving device 114 to rotationally operate the tension roller 103, while maintaining the rotational operation of the heat roller 101. At this time, when the rotation speed of the heat roller 101 is faster than the rotation speed used for transporting, the controller 109 may control the driving device 113 to equalize the rotation speed of the heat roller 101 to the rotation speed used for transporting, and then operate the tension roller 103. The rotational operations of the heat roller 101 and the tension roller 103 may cause the cutout 104*c* of the endless belt 104 to move from the fixing nip part N1 toward the tension roller 103. The position sensor 110 detects and outputs a detection signal when the cutout 104*c* has left the fixing nip part N1. In response to the detection signal of the position sensor 110, the controller 109 may operate the transport device 130 so as to advance the paper sheet TP into the fixing nip part N1. At this time, the cooling device 105 may also starts operating. As the paper sheet TP is once again heated and pressurized at the fixing nip part N1, the toner image is heat-fused anew (re-melted). The temperature of the fixing nip part N1 may be a melting temperature or more of the toner used for the paper sheet TP (e.g. the fixing nip part N1 may reach or exceed a temperature at which the toner fuses), for example 130° C. to 150° C. The heat-fused (re-melted) toner image may be transported toward the cooling device 105, while being in a state of overlay (or abutment) with a portion of the endless belt 104 devoid of the cutout.

Figure 7C:
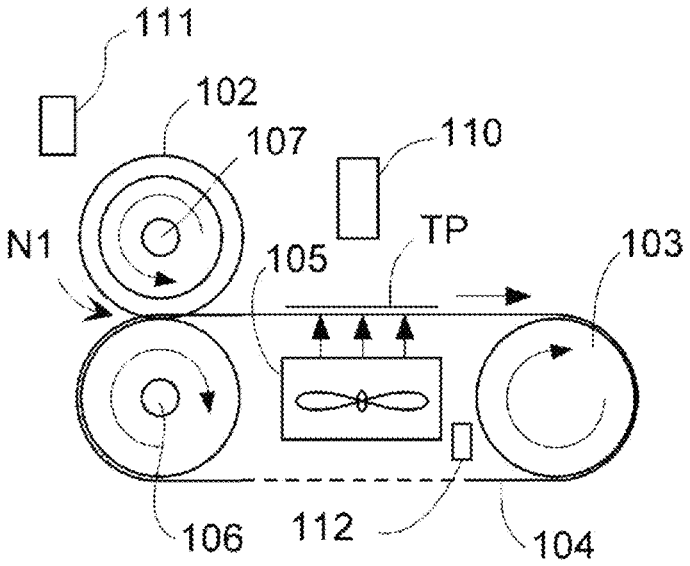
FIG. 7*c* is a schematic side plan view of an example fixing device in a state where an example re-melted (e.g. heat-fused) toner image is transported above a cooling device while being in a state of overlay (or abutment) with a portion of the endless belt devoid of the cutout.
Figure 7D:
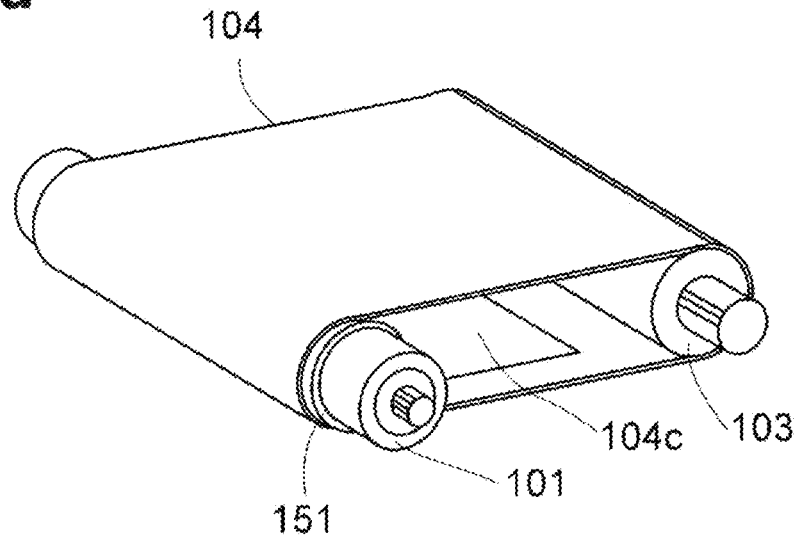
FIG. 7*d* is a schematic perspective view of the example fixing device shown in FIG. 7*c*.
Figure 7E:
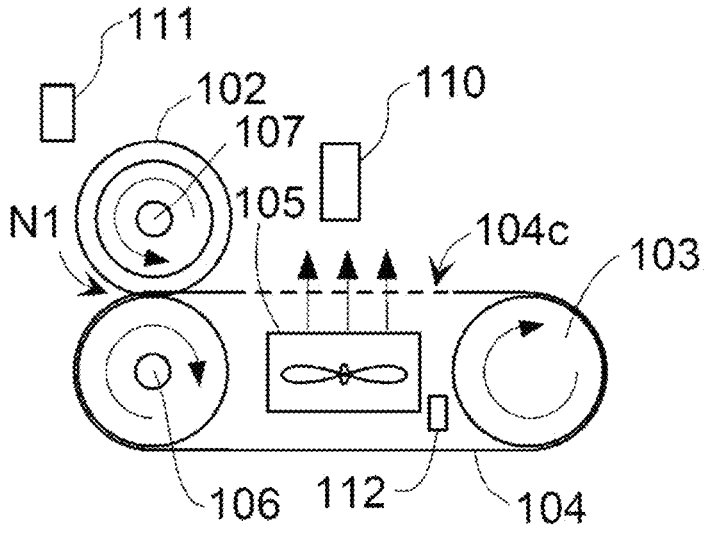
FIG. 7*e* is a schematic side plan view of an example fixing device in a state where air is discharged from a space surrounded by the example endless belt to the outside.
Figure 7F:
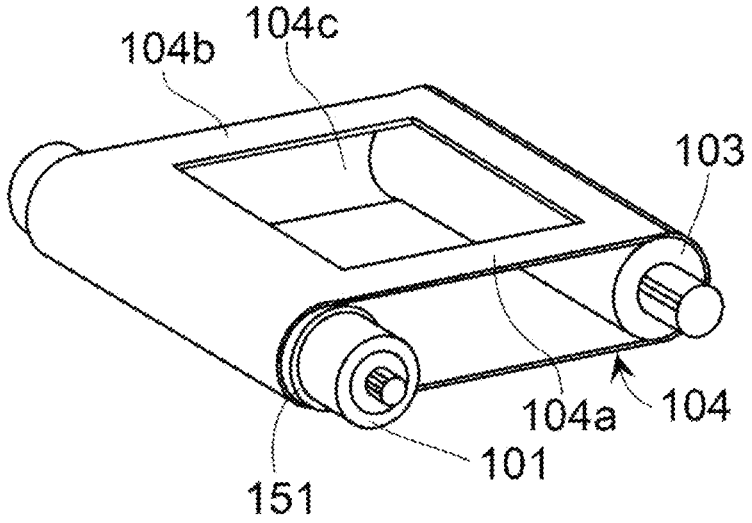
FIG. 7*f* is a schematic perspective view of the example fixing device shown in FIG. 7*e*.

FIGS. 7*c* and 7*d* show a state where the heat-fused (re-melted) toner image is transported above the cooling device 105 in a state of overlay (or abutment) with a portion of the endless belt 104 devoid of the cutout. The heat-fused (re-melted) toner image is cooled by the cooling device 105 in a state of overlay (or abutment) with a portion of the endless belt 104 devoid of the cutout. As the paper sheet TP is in overlay (or abutment) with a portion of the endless belt 104 devoid of the cutout at that time, the heat-fused (re-melted) toner image reproduces the mirror-finished surface of the endless belt and solidifies. Thereby, the surface of the paper sheet TP formed with the toner image can be made glossy. The paper sheet TP may be further transported toward the tension roller. As the endless belt changes the transport direction at the tension roller, the paper sheet TP is released from the endless belt 104 and discharged by the discharge device 140. Note that, while the heat roller 101 and the tension roller 103 are shown as rollers having substantially a same diameter, the diameter of the tension roller 103 may be made smaller than the diameter of the heat roller 101 so as to make the release of the paper sheet TP easier.

During the operation of the fixing apparatus 100, the temperature within the space surrounded by the endless belt 104 increases due to the influence of the heat roller 101. When the temperature within this space exceeds about 50° C., for example, it may be considered to have a negative influence on the fixing device 100. When the cooling device 105 is a blower device, the controller 109 may stop feeding the paper sheet TP in response to a detection signal of the temperature sensor 112 detecting the temperature within the space, and may then move the endless belt 104 so that the cutout 104*c* of the endless belt 104 registers with the blowing part of the cooling device (blower device) 105 (see FIGS. 7*e* and 7*f*). The air within the space surrounded by the endless belt 104 is thereby discharged to the outside of the endless belt 104 by the cooling device (blower device) 105, and increase in the temperature can be suppressed in the space surrounded by the endless belt 104.

It is to be understood that not all aspects, advantages and features described herein may necessarily be achieved by, or included in, any one particular example. Indeed, having described and illustrated various examples herein, it should be apparent that other examples may be modified in arrangement and detail.

The invention claimed is:

1. A fixing device comprising:

a heat roller including a heating device;

a tension roller;

an endless belt tensioned around the heat roller and the tension roller to move in a loop;

a pressure roller to make pressure contact with the heat roller via the endless belt to form a fixing nip part; and a cooling device disposed on an inner peripheral surface side of the endless belt to cool a portion of the endless belt when the portion moves from the heat roller to the tension roller, wherein the endless belt has a cutout, the heat roller to rotate in direct contact with the pressure roller through the cutout.

2. The fixing device according to claim 1, wherein the cutout of the endless belt is cut to leave lateral edges on both sides of the endless belt, and the heat roller includes a contact portion to contact the pressure roller, and bearings located at opposite ends of the heat roller outside the contact portion of the heat roller, the bearings to contact the lateral edges of the endless belt.

3. The fixing device according to claim 1, wherein in a direction of movement of the endless belt, the cutout of the endless belt has a length that is longer than half of a total length of an outer circumference of the heat roller and shorter than the total length of the outer circumference of the heat roller, and a width larger than a width over which the heat roller contacts the pressure roller.

4. The fixing device according to claim 1, comprising a first driving device to rotationally drive the heat roller and a second driving device to rotationally drive the tension roller.

5. The fixing device according to claim 2, wherein, when the cutout of the endless belt is located at the fixing nip part, the heat roller to rotate in contact with the pressure roller and the endless belt to be operated in a stopped state wherein the first driving device rotationally drives the heat roller and the second driving device is in a state of non-operation.

6. The fixing device according to claim 1, comprising a position sensor to detect a position of the cutout of the endless belt.

7. The fixing device according to claim 1, comprising a temperature sensor to detect a surface temperature of the pressure roller.

8. The fixing device according to claim 1, wherein the heating device includes a first heating device and the pressure roller includes a second heating device.

9. The fixing device according to claim 1, wherein the cooling device includes a blower device or a heat sink.

10. The fixing device according to claim 9, wherein the cooling device includes a blower device to discharge air from a space surrounded by the endless belt, to an outside of the space, through the cutout of the endless belt.

11. A method for manufacturing a fixing device comprising:

tensioning an endless belt around a heat roller containing a heating device and a tension roller to enable movement of the endless belt in a loop;

pressure-contacting a pressure roller toward the heat roller via the endless belt to form a fixing nip part;

disposing a cooling device on an inner peripheral surface side of the endless belt to cool a portion of the endless belt moving from the heat roller to the tension roller; and forming a cutout in the endless belt to rotate the heat roller in direct contact with the pressure roller.

12. A fixing device comprising:

a pair of rollers including a heat roller and a tension roller;

an endless belt to rotate about the heat roller and the tension roller, wherein the endless belt has a cutout;

a pressure roller to press the endless belt against the heat roller; and a cooling device located adjacent a portion of the endless belt, the portion of the endless belt to move from the heat roller to the tension roller, the heat roller to directly contact the pressure roller through the cutout, when the cutout of the endless belt is located between the pressure roller and the heat roller.

13. The fixing device according to claim 12, wherein the heat roller includes a contact portion to contact the pressure roller, and bearings located at opposite ends of the heat roller outside the contact portion, and the endless belt includes lateral edges on opposite sides of the cutout to contact the bearings of the heat roller.

14. The fixing device according to claim 12, wherein in a direction of movement of the endless belt, the cutout has a length that is longer than half of a total length of an outer circumference of the heat roller and shorter than the total length of the outer circumference of the heat roller, and a width larger than a width over which the heat roller and the pressure roller come in contact with each other.

15. The fixing device according to claim 12 wherein, when the cutout of the endless belt is located at the fixing nip part, the endless belt to stop moving, and the heat roller to rotate in contact with the pressure roller through the cutout of the endless belt.

* * * * *